US008814328B2

(12) United States Patent
Redding et al.

(10) Patent No.: US 8,814,328 B2
(45) Date of Patent: Aug. 26, 2014

(54) POLYMER FILM AS AN INTERSTITIAL FILL FOR PZT PRINTHEAD FABRICATION

(75) Inventors: Gary D Redding, Victor, NY (US); Bryan R Dolan, Rochester, NY (US); Mark A Cellura, Webster, NY (US); Peter J Nystrom, Webster, NY (US)

(73) Assignee: Xerox Corporation, Norwalk, CT (US)

( * ) Notice: Subject to any disclaimer, the term of this patent is extended or adjusted under 35 U.S.C. 154(b) by 77 days.

(21) Appl. No.: 13/323,867

(22) Filed: Dec. 13, 2011

(65) Prior Publication Data

US 2013/0147881 A1 Jun. 13, 2013

(51) Int. Cl.
*B41J 2/045* (2006.01)

(52) U.S. Cl.
USPC ..... 347/68

(58) Field of Classification Search
None
See application file for complete search history.

(56) References Cited

U.S. PATENT DOCUMENTS

| | | | | |
|---|---|---|---|---|
| 5,752,303 | A * | 5/1998 | Thiel | 29/25.35 |
| 6,358,767 | B2 * | 3/2002 | Eguchi | 438/30 |
| 2006/0066686 | A1 * | 3/2006 | Mita | 347/68 |

OTHER PUBLICATIONS

U.S. Appl. No. 13/097,182, titled "High Density Electrical Interconnect for Printing Devices Using Flex Circuits and Dielectric Underfill," filed Apr. 29, 2011.

U.S. Appl. No. 13/011,409, titled "Polymer Layer Removal on PZT Arrays Using a Plasma Etch," filed Jan. 21, 2011.

* cited by examiner

*Primary Examiner* — Matthew Luu
*Assistant Examiner* — Erica Lin
(74) *Attorney, Agent, or Firm* — MH2 Technology Law Group LLP

(57) ABSTRACT

A method and structure for an ink jet printhead, and a printer including the ink jet printhead. The printhead can include a polymer as a film spacer which separates an electrical interconnect such as a printed circuit board or a flexible circuit from a printhead diaphragm, such that the film spacer is interposed between the electrical interconnect and the diaphragm. In an embodiment, a piezoelectric actuator is free from contact with the film spacer. Embodiments of a process for forming the printhead may have reduced processing stages requiring fewer manufacturing tools than some other processes. Embodiments of the resulting printhead and printer may have fewer structural components than some other printheads and printers.

7 Claims, 6 Drawing Sheets

POLYMER FILM AS AN INTERSTITIAL FILL FOR PZT PRINTHEAD FABRICATION

FIELD OF THE INVENTION

The present teachings relate to the field of ink jet printing devices and, more particularly, to high a density piezoelectric ink jet print head and methods of making a high density piezoelectric ink jet print head.

BACKGROUND OF THE INVENTION

Drop on demand ink jet technology is widely used in the printing industry. Printers using drop on demand ink jet technology can use either thermal ink jet technology or piezoelectric technology. Even though they are more expensive to manufacture than thermal ink jets, piezoelectric ink jets are generally favored as they can use a wider variety of inks and eliminate problems with kogation.

Piezoelectric ink jet print heads typically include a flexible diaphragm and a piezoelectric element attached to the diaphragm. When a voltage is applied to the piezoelectric element, typically through electrical connection with an electrode electrically coupled to a voltage source, the piezoelectric element deflects causing the diaphragm to flex toward a nozzle (aperture or jet) which increases pressure within an ink chamber and expels a quantity of ink from the chamber through the nozzle. As the diaphragm returns to a relaxed state, it flexes away from the nozzle which decreases pressure within the chamber and draws ink into the chamber from a main ink reservoir through an opening to replace the expelled ink.

Increasing the printing resolution of an ink jet printer employing piezoelectric ink jet technology is a goal of design engineers. Increasing the jet density of the piezoelectric ink jet print head can increase printing resolution. One way to increase the jet density is to eliminate manifolds which are internal to a jet stack. With this design, it is preferable to have a single port through the back of the jet stack for each jet. The port functions as a pathway for the transfer of ink from the reservoir to each ink jet chamber. Because of the large number of jets in a high density print head, the large number of ports, one for each jet, must pass vertically through the diaphragm and between the piezoelectric elements.

Manufacturing a high density ink jet print head assembly having an external manifold has required new processing methods. Methods for manufacturing a print head which use less equipment, fewer processing stages, and reduced materials, and the print head resulting from the method, would be desirable.

SUMMARY OF THE EMBODIMENTS

The following presents a simplified summary in order to provide a basic understanding of some aspects of one or more embodiments of the present teachings. This summary is not an extensive overview, nor is it intended to identify key or critical elements of the present teachings nor to delineate the scope of the disclosure. Rather, its primary purpose is merely to present one or more concepts in simplified form as a prelude to the detailed description presented later.

In an embodiment of the present teachings, a method for forming an ink jet printhead can include providing a diaphragm comprising a plurality of openings therethrough, attaching a piezoelectric array comprising a plurality of piezoelectric actuators to the diaphragm, attaching a pre-formed film spacer to the diaphragm at locations directly between adjacent piezoelectric actuators, wherein the pre-formed film spacer is pre-formed prior to attachment to the diaphragm, comprises a polymer layer, and does not directly overlie the plurality of piezoelectric actuators. The method can further include electrically coupling an electrical interconnect to the plurality of piezoelectric actuators, wherein the film spacer and the plurality of piezoelectric actuators are directly interposed between the diaphragm and the electrical interconnect.

In another embodiment, an ink jet printhead can include a diaphragm comprising a plurality of openings therethrough, a piezoelectric actuator array attached to the diaphragm, a pre-formed film spacer attached to the diaphragm at locations directly between adjacent piezoelectric actuators, wherein the pre-formed film spacer comprises a polymer layer and does not directly overlie the plurality of actuators. The ink jet printhead can further include an electrical interconnect electrically coupled to the plurality of actuators, wherein the film spacer and the plurality of piezoelectric actuators are directly interposed between the diaphragm and the electrical interconnect.

In another embodiment, a printer can include an ink jet printhead having a diaphragm comprising a plurality of openings therethrough, a piezoelectric actuator array attached to the diaphragm, a pre-formed film spacer attached to the diaphragm at locations directly between adjacent piezoelectric actuators, wherein the pre-formed film spacer comprises a polymer layer and does not directly overlie the plurality of actuators, and an electrical interconnect electrically coupled to the plurality of actuators, wherein the film spacer and the plurality of piezoelectric actuators are directly interposed between the diaphragm and the electrical interconnect. The printer can further include a housing which encloses the ink jet printhead.

BRIEF DESCRIPTION OF THE DRAWINGS

The accompanying drawings, which are incorporated in and constitute a part of this specification, illustrate embodiments of the present teachings and together with the description, serve to explain the principles of the disclosure. In the figures.

It should be noted that some details of the FIGS. have been simplified and are drawn to facilitate understanding of the present teachings rather than to maintain strict structural accuracy, detail, and scale.

DESCRIPTION OF THE EMBODIMENTS

As used herein unless otherwise specified, the word "printer" encompasses any apparatus that performs a print outputting function for any purpose, such as a digital copier, a bookmaking machine, a facsimile machine, a multi-function machine, a plotter, etc. The word "polymer" encompasses any one of a broad range of carbon-based compounds formed from long-chain molecules including thermosets, thermoplastics, resins such as polycarbonates, epoxies, and related compounds known to the art.

Figure 9:
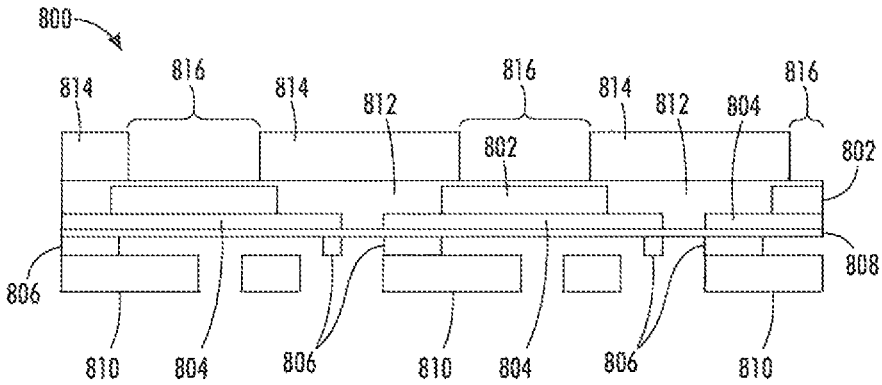
FIGS. 9 and 10 are cross sections depicting intermediate in-process structures according to an embodiment disclosed in copending U.S. patent Ser. No. 13/011,409, filed Jan. 21, 2011, which is incorporated by reference below.

The formation of a printhead having a plurality of piezoelectric transducers (PZT's) has included various structures and technologies, for example as discussed in U.S. patent Ser. No. 13/011,409, titled "Polymer Layer Removal on PZT Arrays Using A Plasma Etch," filed Jan. 21, 2011 and incorporated herein by reference in its entirety. FIG. 9 herein depicts one PZT in-process printhead structure 800 which can be used during the formation of an ink jet printhead. The structure of FIG. 9 depicts one partial and two complete piezoelectric actuators (i.e., actuators, transducers, piezoelectric elements, or piezoelectric transducers) 802 on a patterned stainless steel diaphragm 804, a stainless steel body plate 806, a continuous diaphragm adhesive 808 which attaches the diaphragm 804 to the body plate 806, and a stainless steel inlet/outlet plate 810. After the transducers 802 are attached to the diaphragm 804, a dielectric interstitial material, such as a liquid or paste polymer, is dispensed over the structure to provide a dielectric interstitial layer 812 as depicted. At this stage in the process, the diaphragm adhesive 808 covers openings which extend through the diaphragm 804 so that the interstitial material does not flow through the openings during the application of the flowable polymer interstitial material during formation of the interstitial layer 812. A de-gas process of the interstitial layer 812 can be performed in a de-gas chamber, and the interstitial layer 812 can be planarized using a flat plane and a heated press, then cured at elevated temperatures within an oven.

Next, a process to expose the tops of actuators 802 can be performed. In this process, a patterned mask 814 such as a photoresist layer having openings 816 therethrough which expose the piezoelectric actuators 802 can be formed as depicted, for example using a photolithographic process. The structure of FIG. 9 can include other elements such as adhesive layers which have not been depicted for simplicity.

Subsequently, the interstitial layer 812 of FIG. 9 is etched at the exposed locations 816, for example using a plasma etch in an etch chamber to expose the upper surface of each piezoelectric actuator 802, then the patterned mask 814 is removed. Cleanly etching the interstitial layer 812 from the upper surfaces of the piezoelectric actuators can be a challenge, but is essential for sufficient electrical connection to the piezoelectric elements 802. Additional processing can then be completed on the FIG. 9 structure to form the structure of FIG. 10. For example, a patterned standoff layer 900 is applied to the interstitial layer 812 such that the upper surfaces of the transducers 802 are exposed, and a conductor 902 is applied to the upper surface of the transducers 802. The standoff layer 900 contains the flow of conductor 902 across the actuator 802 to prevent shorting to adjacent actuators 802. A printed circuit board 904 having a plurality of conductive pads 906 can be attached to the upper surface of the structure such that the conductive pads 906 are electrically coupled to the piezoelectric actuators 802 through the conductor 902. Subsequently, the conductor 902 can be cured using an appropriate curing process.

Figure 10:
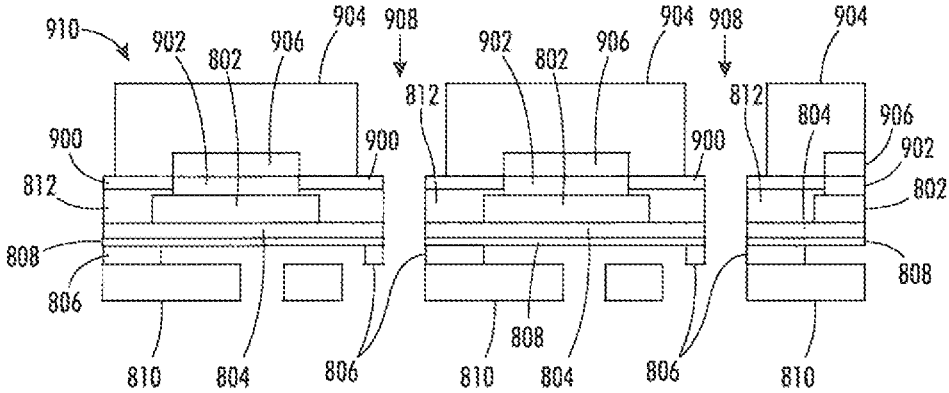

Next, a laser ablation process can be performed from the bottom side of the FIG. 10 structure to clear material including the diaphragm attach adhesive 808, the interstitial layer 812, and the standoff layer 900 which covers the openings within the diaphragm 804 to provide a plurality of ink ports 908 for the flow of ink through the openings in the diaphragm 804. The ink ports 908 can be formed using a laser which ablates the diaphragm attach adhesive 808, the interstitial layer 812, and the standoff layer 900 from the bottom side of the structure depicted in FIG. 9.

In a first laser ablation process, openings through the inlet/outlet plate 810, the body plate 806, and/or the diaphragm 804 itself can be used as a mask to form a self-aligned ink port 908 during an etch. This embodiment can employ the use of a laser beam which is wider than the width of the opening through the diaphragm 804, such that the laser beam is directed onto one or more of the inlet/outlet plate 810, the body plate 806, and the diaphragm 804. In this laser ablation process, the diaphragm 804 can be exposed during the laser ablation process such that ink contacts the diaphragm 804 as it flows through the ink ports 908 during use of the printhead.

In a second laser ablation process, contacting one or more of structures 810, 806, 804 is not desired. In this process, the laser beam can pass through a mask to narrow the beam to a diameter less than a diameter of the opening in the diaphragm 804. The laser beam can be directed through the diaphragm opening so that only structures 808, 812, and 900 are contacted by the laser. In this embodiment, the laser contacts the diaphragm attach adhesive 808 first, then the interstitial layer 812, then the standoff layer 900. In this embodiment, sidewalls of the ink port opening 908 can include the diaphragm attach adhesive 808, the interstitial layer 812, and the standoff layer 900, while neither the stainless steel sidewalls of the openings through the diaphragm 804 nor other portions of the stainless steel diaphragm 804 are exposed by the ink port 908, and ink does not contact the diaphragm 804 as it flows through the ink ports 908 during use of the printhead.

Subsequent to forming the ink port opening 908, the in-process printhead structure 910 of FIG. 10 is completed. A full description of an exemplary process and additional processing stages are discussed in U.S. patent Ser. No. 13/011,409, filed Jan. 21, 2011, which was incorporated by reference above.

Reference will now be made in detail to the embodiments of the present teachings, examples of which are illustrated in the accompanying drawings. Wherever possible, the same reference numbers will be used throughout the drawings to refer to the same or like parts.

Reducing the complexity of a manufacturing process can result in higher yields. Further, a process which uses less manufacturing equipment, requires fewer materials, and reduces manufacturing time can result in a lower cost product. For example, the process used to form the FIG. 10 structure can include the use of a polymer de-gas stage in a de-gas chamber to de-gas the interstitial material layer to remove entrained air, a planarization stage using a flat plate within a heated press to planarize the interstitial layer, a polymer cure in a cure oven to cure the liquid or paste interstitial material layer into a solid interstitial layer, and a plasma etch process within an etch chamber to remove the solid interstitial layer to expose the piezoelectric actuators. In some printhead designs and processes, these tools and materials may be required. An embodiment of the present teachings can include a method for forming an ink jet printhead, an ink jet printhead formed in accordance with the method, a method for forming a printer including the formation of the ink jet printhead, and a printer including the ink jet printhead. The process can include the use of a reduced tool set, a simplified manufacturing process, and a reduced number of structural components required to form the printhead.

Figure 1:
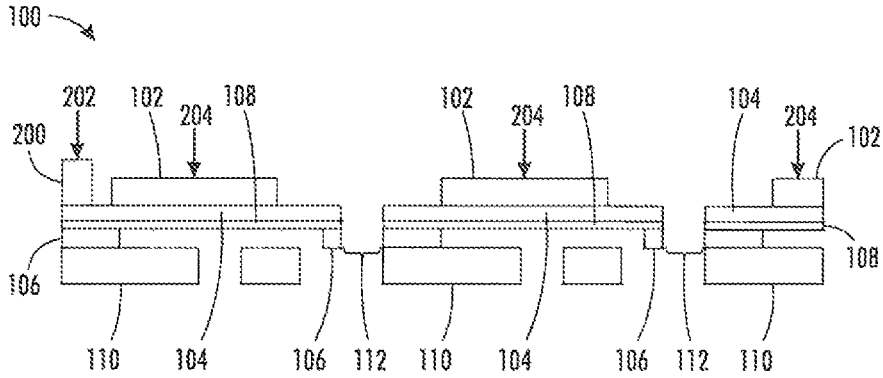
FIGS. 1-6 are cross sections depicting intermediate in-process structures of a portion of an ink jet printhead which can be formed using an embodiment of the present teachings.

FIG. 1 is a cross section depicting an intermediate in-process structure 100 which can be formed according to an embodiment of the present teachings. This embodiment depicts a plurality of piezoelectric actuators 102 attached to a patterned diaphragm 104 such as a stainless steel diaphragm.

FIG. 1 further depicts a patterned body plate 106 such as a stainless steel body plate, a diaphragm adhesive 108 which physically connects the diaphragm 104 and the plurality of actuators 102 to the body plate 106, and a patterned inlet/outlet plate 110, for example a stainless steel inlet/outlet plate. It will be understood that the depiction of the FIG. 1 structure is only part of a printhead assembly, and the number of piezoelectric actuators 102 as part of an piezoelectric actuator array can number in the hundreds or thousands. In this embodiment, a plurality of openings 112 extend through the diaphragm 104, the diaphragm adhesive 108, the body plate 106, and the inlet/outlet plate 110. In this embodiment, the openings 112, in contrast to the FIG. 9 structure, are not blocked by the diaphragm adhesive 108 (808 in FIG. 9), although other embodiments are contemplated where the openings 112 are covered and cleared during a subsequent laser ablation process. Before attaching the diaphragm 104 to the body plate 106, the diaphragm adhesive 108 can be patterned, for example using laser ablation, a cutting die in a stamping process, or a masked etch in an etching process, to form openings 112 through the diaphragm adhesive 108. In another embodiment, the diaphragm adhesive 108 can be a selectively applied liquid which is subsequently cured.

Figure 2:
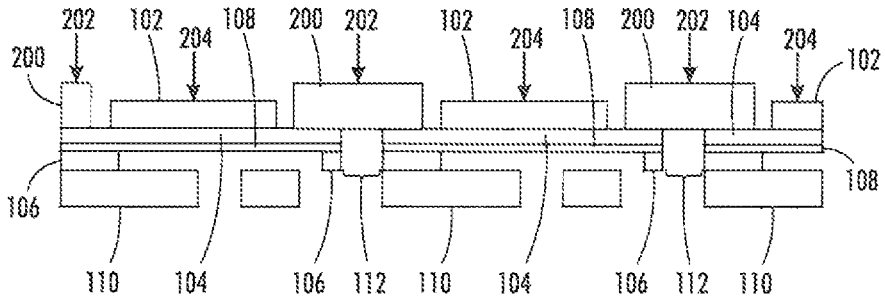

After forming a structure similar to that depicted in FIG. 1, a film spacer 200 is bonded or attached to the diaphragm 104 as depicted in FIG. 2. The film spacer 200 can be pre-formed to include a plurality of ribs, with a rib located between adjacent actuators or, for example, within every other space between actuators, etc. In this embodiment, the film spacer 200 does not overlie the actuators 102, and thus does not need to be removed from the upper surface 204 of the actuators 102. In this embodiment, an upper surface 202 of the film spacer 200 is at a level which is above an upper surface 204 of each actuator 102. In other words, the two upper surfaces 202, 204 are not coplanar. Further, the film spacer 200 is directly interposed between adjacent actuators 102 in a direction parallel to the upper surface of the diaphragm 104. In an embodiment, a lower surface of both the actuators 102 and the film spacer 200 reside on the diaphragm 104. In an embodiment, the piezoelectric actuators 102 can be between about 5 μm and about 150 μm thick, while the film spacer 200 is between about 5 μm and about 500 μm thick. The film spacer 200 can include, for example, a polyimide film, for example Upilex® available from Ube Industries. The polyimide film can be coated on both the top and bottom sides with an adhesive such as a thermoset adhesive (depicted in FIG. 6, for simplicity), wherein the bottom adhesive is used to attach the polyimide film to the diaphragm 104. In another embodiment, the film spacer 200 includes an adhesive such as a thermoset only on the bottom surface of a polymer core, and the adhesive is used to attach the film spacer 200 to the diaphragm 104, and may also be used to attach the piezoelectric actuators 102 to the diaphragm 104. In another embodiment, an adhesive is applied to the top surface of the diaphragm 104 which is used to attach both the piezoelectric transducers 102 and the film spacer 200 to the diaphragm 104.

In the present embodiment, the film spacer 200 covers the opening 112 through the diaphragm 104 as depicted in FIG. 2, although in another embodiment an opening can be pre-formed through the film spacer 200 if the film spacer 200 can be placed with sufficient precision. However, for different printhead designs, covering the openings 112 with film spacer 200 may prevent a subsequent adhesive from plugging the opening 112 as described below. As depicted in FIG. 2, while the film spacer 200 covers the opening 112 through the diaphragm 104, the diaphragm adhesive 108 does not cover the opening 112 through the diaphragm 104 in this embodiment.

Figure 3:
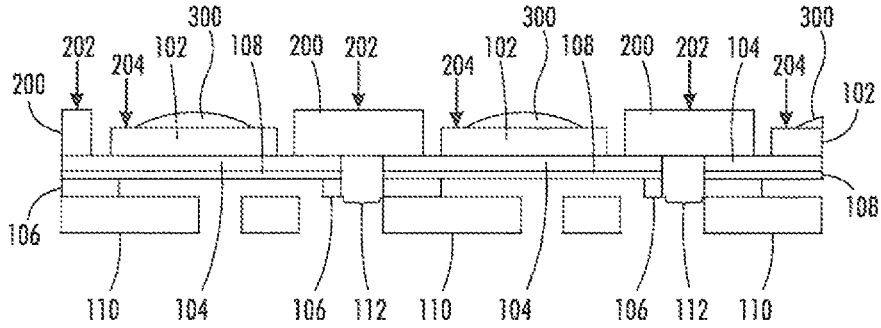

After forming a structure similar to that depicted in FIG. 2, a quantity of adhesive 300 can be dispensed onto an upper surface 204 of each transducer 102 as depicted in FIG. 3. In an embodiment, the adhesive 300 is a conductor, for example solder, a conductor-filled conductive paste, or a z-axis conductor. In another embodiment, the adhesive is a nonconductor (dielectric) such as epoxy. In yet another embodiment described below, no adhesive is used.

Figure 4:
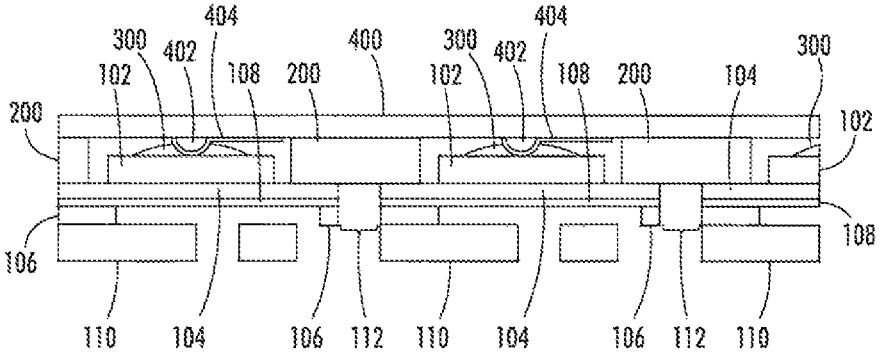

Subsequently, an electrical interconnect 400 such as a printed circuit board (PCB), flexible (flex) circuit, or flex cable assembly can be attached to the FIG. 3 structure using the adhesive 300 to result in the structure of FIG. 4. The electrical interconnect 400 can include a plurality of bumps 402 and traces 404. The bumps 402 can be conductive bumps, a conductive pad, or pre-formed bumps such as those discussed in U.S. patent application Ser. No. 13/097,182 filed Apr. 29, 2011, which is incorporated by reference herein in its entirety. In this embodiment, the film spacer 200 and the actuators 102 are directly interposed between the electrical interconnect 400 and the diaphragm 104 in a direction perpendicular to the upper surface of the diaphragm 104, but the film spacer 200 is not directly interposed between the electrical interconnect 400 and the actuators 102. The traces 404 can route signals to other locations on the electrical interconnect 400 to provide for electrical connection with, for example, a printhead driver board in accordance with known techniques. An electrical signal can be routed via traces 404 from the driver board (not individually depicted for simplicity) to the bumps 402, and then to the piezoelectric actuators 102 such that each piezoelectric actuator 102 can be individually addressed.

In an embodiment, the adhesive 300 is conductive and electrical coupling between each bump 402 and one of the piezoelectric actuators 102 is established through the conductive adhesive 300. In this embodiment, the conductive adhesive 300 can also physically secure the electrical interconnect 400 to the piezoelectric actuators 102 as well as enabling electrical communication between each piezoelectric actuator 102 and the bump 402. In this embodiment using a conductive adhesive 300, each bump 402 may or may not physically contact one of the piezoelectric actuators 102, as electrical communication can be established by the conductive adhesive 300.

In another embodiment, the adhesive 300 can be a nonconductor. In this embodiment, electrical coupling between each bump 402 and one of the piezoelectric actuators 102 can be established through physical contact between each bump 402 and one of the piezoelectric actuators 102, for example using a plurality of asperities as discussed in U.S. patent application Ser. No. 13/097,182 which was incorporated by reference above. In this embodiment, each bump 402 physically contacts one of the piezoelectric actuators 102. Electrical contact between each bump 402 and one of the piezoelectric actuators 102 is established through physical contact between the two structures. In this embodiment, the nonconductive adhesive 300 can physically secure the electrical interconnect 400 to the plurality of piezoelectric actuators 102.

In yet another embodiment, the use of adhesive 300 between each bump 402 and one of the piezoelectric actuators 102 can be omitted. In this embodiment, each bump 402 can be held in physical contact with one of the piezoelectric actuators 102 by the adjacent mechanical bond between the electrical interconnect 400 and film spacer 200. In this embodiment, electrical contact between each bump 402 and its associated piezoelectric actuator 102 is established through physical contact between the two structures 402, 102, and is secured by the mechanical attachment of the electrical interconnect 400 to the film spacer 200.

Figure 5:
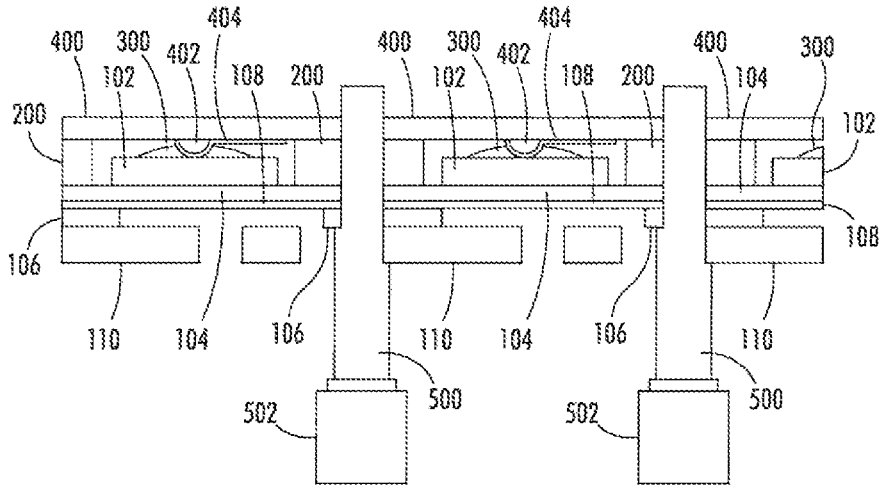

Subsequently, the openings 112 through which ink passes during operation of the printhead can be cleared using a laser beam 500 output by a laser 502 as depicted in FIG. 5. Ablating a portion of the film spacer 200 and the electrical interconnect 400 can result in a structure wherein the openings 112 form a plurality of ink ports which extend through the film spacer 200 and the electrical interconnect 400 similar to that depicted in FIG. 6. Depending on the design of the printhead, the laser 502 can use the diaphragm 104 and/or the body plate 106 and inlet/outlet plate 110 as a mask during ablation of the film spacer 300 which covers the openings 112 through the diaphragm 104. In this embodiment, the openings 112 through the film spacer 200 and the electrical interconnect 400 are self-aligned to the openings through the diaphragm. Subsequently, processing can continue to form a completed printhead.

Figure 6:
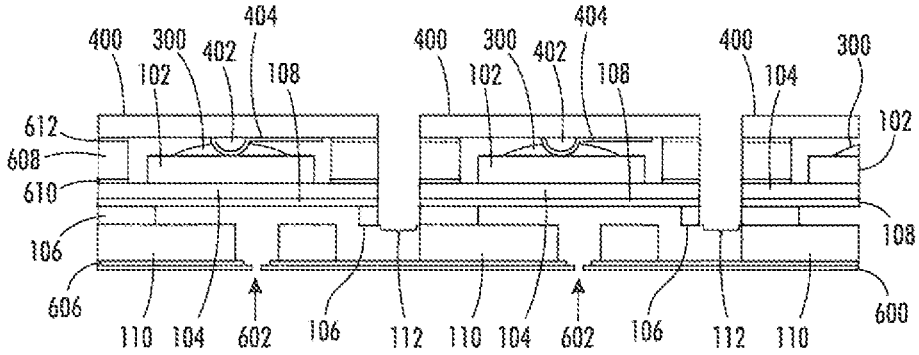

The completed printhead can include various structures. For example, FIG. 6 depicts an aperture plate 600 having a plurality of nozzles 602, wherein the aperture plate 600 is attached to the inlet/outlet plate 110 using an aperture plate adhesive 606. FIG. 6 further depicts a polymer layer 608 such as a polyimide film layer which forms at least a portion of the film spacer 200 of FIG. 2, a first adhesive layer 610 which attaches the polymer layer 608 to the diaphragm 104, and a second adhesive layer 612 which attaches the polymer layer 608 to the interconnect layer 400. The first adhesive layer 610 can first be attached to either the diaphragm 104 or the polymer layer 608, and then to the other of the diaphragm 104 or the polymer layer 608 to secure the diaphragm 104 to the polymer layer 608. The first adhesive layer 610 can also be used to connect each piezoelectric actuator 102 to the diaphragm 104.

The second adhesive layer 612 can first be attached to either the interconnect layer 400 or the polymer layer 608, and then to the other of the interconnect layer 400 or the polymer layer 608 to secure the electrical interconnect 400 to the polymer layer 608. In another embodiment, no adhesive is formed between the electrical interconnect 400 and the film spacer 200, in which case the electrical interconnect 400 is physically attached to the piezoelectric actuators by adhesive 300. It will be understood that a completed printhead can have additional structures which are not depicted for simplicity, and various depicted structures can be removed or modified.

Figure 7:
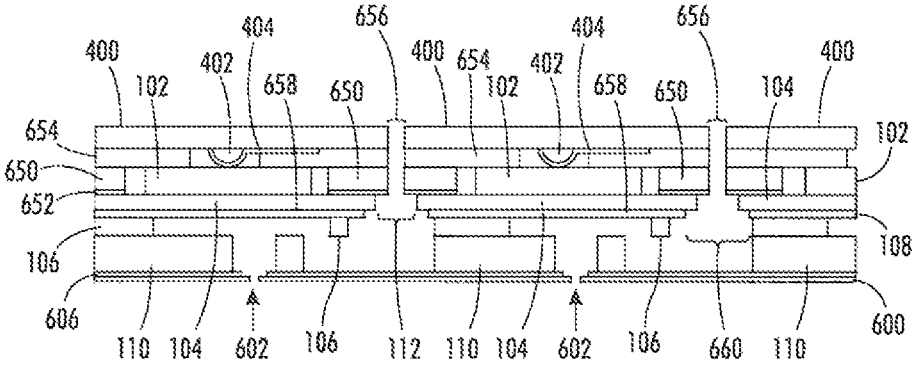
FIG. 7 is a cross section depicting an intermediate in-process structure of a portion of an ink jet printhead which can be formed using another embodiment of the present teachings.

FIG. 7 depicts another embodiment in which an upper surface of a film spacer 650 is generally coplanar with (i.e., at generally a same level as) an upper surface of the piezoelectric actuators 102. The film spacer 650 can be attached to the diaphragm 104 with an adhesive 652 such that the film spacer 650 is generally the same height as the piezoelectric actuators 102 as depicted. FIG. 7 further depicts a standoff layer 654 which bonds to the upper surfaces of the film spacer 650 and the piezoelectric actuators 102. The standoff layer 654, for example an adhesive, can provide a mechanical bond of the electrical interconnect 400 to the film spacer 650 and to the piezoelectric actuators 102. This mechanical bond can also hold each bump 402 in physical contact with one of the piezoelectric actuators 102 such that additional conductive and mechanical attachments are not required to electrically couple the bumps 402 to the piezoelectric actuators 102. In this embodiment, each bump 402 is free from physical contact with either a conductive adhesive or a nonconductive adhesive. The traces 404 can physically contact the standoff layer 612, which can be an adhesive. Electrical coupling of the bumps 402 to the piezoelectric actuators can be established as described above, for example using one or more asperities. In another embodiment, a conductor or nonconductor similar to material 300 described above can be used with the FIG. 7 embodiment, in which case the opening within the standoff layer 654 can contain the flow of adhesive away from the bumps 402. In this embodiment, the standoff layer directly overlies the plurality of piezoelectric actuators in a direction perpendicular to an upper surface of the diaphragm, but the film spacer does not directly overlie the plurality of piezoelectric actuators in a direction perpendicular to an upper surface of the diaphragm.

FIG. 7 further depicts an embodiment in which a separate mask can be used to form openings 656 through the adhesive 652, the film spacer 650, the standoff layer 612, and the electrical interconnect 400 to form ink ports. Each opening 656 can have a diameter (in the case of circular openings) or width (in the case of non-circular openings) which is less than the diameter (width) of the opening 112 through the diaphragm 104.

Further, the diaphragm attach adhesive 658 can be patterned prior to attachment to the diaphragm 104. In this embodiment, a width of openings 660 through the diaphragm attach adhesive 658 can be wider than a width of openings 112 through the diaphragm 104. Additionally, the width of openings 112 through the diaphragm 104 are wider than a width of opening 656 through layers 652, 650, 654, and 400. The plurality of openings 660 through the diaphragm attach adhesive 658 align with the plurality of openings 112 through the diaphragm, and are targeted to be concentric therewith.

In the FIG. 7 embodiment, a mask (not depicted for simplicity) having a plurality of openings can be aligned with the printhead structure prior to attachment of the aperture plate 600 and interposed between a laser and the diaphragm attach adhesive 658. The openings 112 in the diaphragm 104 can be used as alignment indicia for alignment of the mask with the printhead structure. A laser beam output by the laser can extend through the openings in the mask, through the openings 660 in the diaphragm attach adhesive 658 and through the openings 112 in the diaphragm, and begin etching on the adhesive 652. In contrast to some prior processes, the diaphragm attach adhesive 658 does not need to be etched by the laser because the openings 660 are pre-formed. The openings 658 can be pre-formed because, for example, a liquid interstitial material is not dispensed onto the upper surface of the diaphragm 104, and thus the openings 112 through the diaphragm do not need to be covered to prevent the flow of interstitial material through openings 112. An advantage of pre-forming openings 660 in diaphragm attach adhesive 658 is that the laser etch can start at the adhesive 652 and not at the diaphragm attach adhesive 658. Because a laser-etched opening typically has a taper, less material thickness is laser etched, resulting from pre-formed layer 658. Thus when the laser beam exits the top of structure 400 to form a laser exit opening, the diameter of the laser exit opening at the top of layer 400 is larger than it would be if diaphragm attach adhesive 658 had covered the opening 112 and had required etching. In an embodiment, the diaphragm 104 is exposed to the ink during the flow of ink through the ink port formed by openings 656, 112, and 660, but a laser does not need to contact any of the diaphragm attach adhesive 658, the diaphragm 104, the body plate 106, or the inlet/outlet plate 110.

In an embodiment, opening 660 through diaphragm attach adhesive 108 can have a width of between about 100 μm and about 250 μm, or between about 125 μm and about 225 μm, or between about 150 μm and about 200 μm, for example about 175 μm. Opening 112 through the diaphragm 104 can have a width of between about 75 μm and about 225 μm, or between about 100 μm and about 200 μm, or between about 125 μm and about 175 μm, for example about 150 μm. Opening 656 through the adhesive 652, the film spacer 650, the standoff layer 654, and the conductive interconnect 400 can have a width of between about 25 μm and about 175 μm, or between about 50 μm and about 150 μm, or between about 75 μm and about 125 μm, for example about 100 μm.

Additionally, an opening 656 which can be selectively formed to a desired size and which is smaller than the opening 112 within the diaphragm 104 may also be useful to provide a mechanism for tuning the flow of ink within the printhead (i.e., for tuning the fluidic circuit) without a redesign of the diaphragm 104. After forming opening 658, the aperture plate 600 can be attached to the inlet/outlet plate 110 using adhesive 606.

Figure 8:
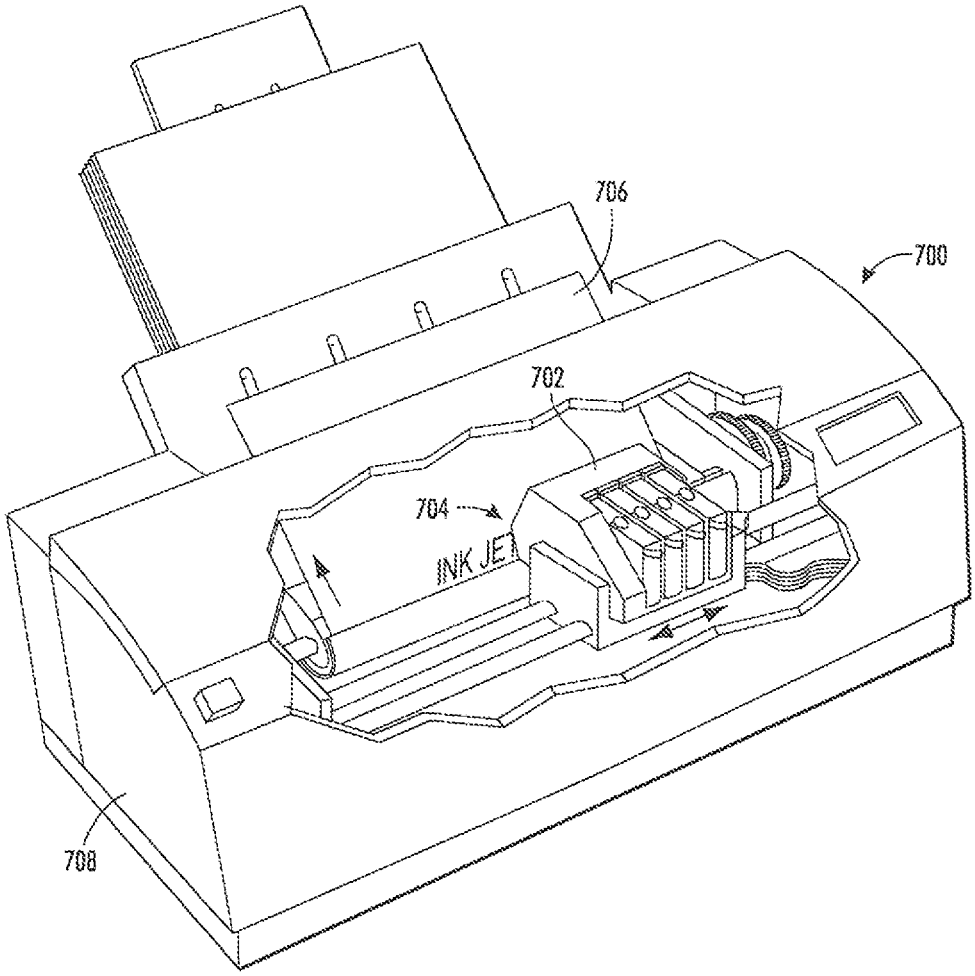
FIG. 8 is a perspective view of a printer which can include a printhead according to the present teachings.

Once manufacture of the printhead is complete, one or more printheads according to the present teachings can be installed in a printer. FIG. 8 depicts a printer 700 including one or more printheads 702 and ink 704 being ejected from one or more nozzles 602 (FIGS. 6 and 7, for example) in accordance with an embodiment of the present teachings. Each printhead 702 is configured to operate in accordance with digital instructions to create a desired image on a print medium 706 such as a paper sheet, plastic, etc. Each printhead 702 may move back and forth relative to the print medium 706 in a scanning motion to generate the printed image swath by swath. Alternately, the printhead 702 may be held fixed and the print medium 706 moved relative to it, creating an image as wide as the printhead 702 in a single pass. The printhead 702 can be narrower than, or as wide as, the print medium 706. The printer hardware including the printhead 702 can be enclosed in a printer housing 708. In another embodiment, the printhead 802 can print to an intermediate surface such as a rotating drum or belt (not depicted for simplicity) for subsequent transfer to a print medium.

As will be understood by the disclosure herein, a printhead according the an embodiment of the present teachings can be formed without the requirement for a polymer de-gas stage in a de-gas chamber to de-gas a liquid or paste interstitial material layer, a planarization stage using a flat plate within a heated press to planarize an interstitial material layer, a polymer cure in a cure oven to cure a liquid or paste interstitial material into a solid interstitial layer, and a plasma etch process within an etch chamber to remove a solid interstitial layer to expose the piezoelectric actuators. The material of the film spacer, such as a polyimide film or other polymer, may be more compatible with ink during use of the printhead than other materials such as a two part paste which can form an interstitial layer.

Also, as depicted in FIG. 5 for example, the film spacer 200 does not physically contact the plurality of piezoelectric actuators 102. This is in contrast, for example, to the interstitial layer 812 of FIG. 10 which physically contacts the plurality piezoelectric actuators 802. Physical contact may have a dampening effect on the piezoelectric actuators 802. For example, a pressure pulse transferred to the ink by deflection of the piezoelectric actuators 102 and through the diaphragm may be decreased as a result of contact between an interstitial layer and the piezoelectric actuators 102. Thus a spike of a pressure pulse transferred to the ink may be improved in an embodiment of the present teachings, for example because there is no physical contact between the film spacer 200 and the plurality of piezoelectric elements 102.

Notwithstanding that the numerical ranges and parameters setting forth the broad scope of the present teachings are approximations, the numerical values set forth in the specific examples are reported as precisely as possible. Any numerical value, however, inherently contains certain errors necessarily resulting from the standard deviation found in their respective testing measurements. Moreover, all ranges disclosed herein are to be understood to encompass any and all sub-ranges subsumed therein. For example, a range of "less than 10" can include any and all sub-ranges between (and including) the minimum value of zero and the maximum value of 10, that is, any and all sub-ranges having a minimum value of equal to or greater than zero and a maximum value of equal to or less than 10, e.g., 1 to 5. In certain cases, the numerical values as stated for the parameter can take on negative values. In this case, the example value of range stated as "less than 10" can assume negative values, e.g. −1, −2, −3, −10, −20, −30, etc.

While the present teachings have been illustrated with respect to one or more implementations, alterations and/or modifications can be made to the illustrated examples without departing from the spirit and scope of the appended claims. For example, it will be appreciated that while the process is described as a series of acts or events, the present teachings are not limited by the ordering of such acts or events. Some acts may occur in different orders and/or concurrently with other acts or events apart from those described herein. Also, not all process stages may be required to implement a methodology in accordance with one or more aspects or embodiments of the present teachings. It will be appreciated that structural components and/or processing stages can be added or existing structural components and/or processing stages can be removed or modified. Further, one or more of the acts depicted herein may be carried out in one or more separate acts and/or phases. Furthermore, to the extent that the terms "including," "includes," "having," "has," "with," or variants thereof are used in either the detailed description and the claims, such terms are intended to be inclusive in a manner similar to the term "comprising." The term "at least one of" is used to mean one or more of the listed items can be selected. Further, in the discussion and claims herein, the term "on" used with respect to two materials, one "on" the other, means at least some contact between the materials, while "over" means the materials are in proximity, but possibly with one or more additional intervening materials such that contact is possible but not required. Neither "on" nor "over" implies any directionality as used herein. The term "conformal" describes a coating material in which angles of the underlying material are preserved by the conformal material. The term "about" indicates that the value listed may be somewhat altered, as long as the alteration does not result in nonconformance of the process or structure to the illustrated embodiment. Finally, "exemplary" indicates the description is used as an example, rather than implying that it is an ideal. Other embodiments of the present teachings will be apparent to those skilled in the art from consideration of the specification and practice of the disclosure herein. It is intended that the specification and examples be considered as exemplary only, with a true scope and spirit of the present teachings being indicated by the following claims.

Terms of relative position as used in this application are defined based on a plane parallel to the conventional plane or working surface of a workpiece, regardless of the orientation of the workpiece. The term "horizontal" or "lateral" as used in this application is defined as a plane parallel to the conventional plane or working surface of a workpiece, regardless of the orientation of the workpiece. The term "vertical" refers to a direction perpendicular to the horizontal. Terms such as "on," "side" (as in "sidewall"), "higher," "lower," "over," "top," and "under" are defined with respect to the conventional plane or working surface being on the top surface of the workpiece, regardless of the orientation of the workpiece.

The invention claimed is:

1. An ink jet printhead, comprising:

a diaphragm comprising a plurality of openings therethrough, a first side, and a second side opposite the first side;

a piezoelectric actuator array, wherein each piezoelectric actuator within the printhead is attached to the first side of the diaphragm;

a pre-formed film spacer attached to the first side of the diaphragm at locations directly between adjacent piezoelectric actuators, wherein the pre-formed film spacer comprises a polymer layer and does not directly overlie the plurality of actuators;

an electrical interconnect electrically coupled to the plurality of actuators, wherein the film spacer and the plurality of piezoelectric actuators are directly interposed between the diaphragm and the electrical interconnect in a direction perpendicular to the first side of the diaphragm; and an aperture plate comprising a plurality of nozzles, wherein the second side of the diaphragm is at a level interposed between each piezoelectric actuator within the printhead and the aperture plate.

2. The ink jet printhead of claim 1, further comprising:

the film spacer does not directly overlie the plurality of piezoelectric actuators in a direction perpendicular to an upper surface of the diaphragm.

3. The ink jet printhead of claim 1, further comprising:

a plurality of openings through the film spacer aligned with the plurality of openings through the diaphragm which provide a plurality of ink ports.

4. The ink jet printhead of claim 3, further comprising:

a plurality of openings through the electrical interconnect aligned with the plurality of openings through the film spacer and the plurality of openings through the diaphragm which provide a plurality of ink ports.

5. The ink jet printhead of claim 4, wherein:

a diameter or width of each of the plurality of openings through the electrical interconnect and a diameter or width of each of the plurality of openings through the film spacer are smaller than a diameter or width of each of the plurality of openings through the diaphragm;

a diameter or width of a plurality of openings through a diaphragm attach adhesive is larger than the diameter or width of each of the plurality of openings through the diaphragm; and the plurality of ink ports are at least partly formed by the plurality openings through the diaphragm attach adhesive, the plurality of openings through the diaphragm, the plurality of openings through the film spacer, and the plurality of openings through the conductive interconnect.

6. The ink jet printhead of claim 1, further comprising:

the film spacer comprises a polyimide layer;

a first layer of adhesive which attaches the polyimide layer to the diaphragm and which attaches the plurality of piezoelectric actuators to the diaphragm; and a second layer of adhesive which attaches the polyimide layer to the electrical interconnect.

7. The ink jet printhead of claim 6, wherein the printhead further comprises:

a standoff layer attached to the upper surface of the pre-formed film spacer and to the upper surface of each piezoelectric actuator, wherein an upper surface of the pre-formed film spacer is generally coplanar with an upper surface of each piezoelectric actuator and the standoff layer directly overlies the plurality of piezoelectric actuators in a direction perpendicular to an upper surface of the diaphragm and the film spacer does not directly overlie the plurality of piezoelectric actuators in a direction perpendicular to an upper surface of the diaphragm.

* * * * *